United States Patent [19]

Wieland

[11] Patent Number: 4,546,817

[45] Date of Patent: Oct. 15, 1985

[54] ROTOR FOR A REGENERATIVE HEAT EXCHANGER

[75] Inventor: Heinz Wieland, Waldenburg, Fed. Rep. of Germany

[73] Assignee: Wilhelm Gebhardt GmbH, Fed. Rep. of Germany

[21] Appl. No.: 587,405

[22] Filed: Mar. 8, 1984

[30] Foreign Application Priority Data

Mar. 10, 1983 [DE] Fed. Rep. of Germany ..... 3308445

[51] Int. Cl.[4] ..... F28D 19/00

[52] U.S. Cl. ..... 165/10; 165/8; 29/157.3 R

[58] Field of Search ..... 165/10, 8

[56] References Cited

U.S. PATENT DOCUMENTS 2,978,227 4/1961 Hess ..... 165/10

3,373,798 3/1968 Brummett ..... 165/10

*Primary Examiner*—Albert W. Davis, Jr.

*Attorney, Agent, or Firm*—Steven L. Permut; Malcolm L. Sutherland; Leon E. Redman

[57] ABSTRACT

The invention in connection with regenerative heat exchangers and ways of manufacturing them. The outer wall of the tubular rotor of such a heat exchanger is made up of one or more layers of an embossed aluminum strip that are fixed on edge and running radially outwards and in the form of a structure whose generatrix is a radius moving along a helical path, the structure being supported on an inner core. The embossing process is responsible for producing folds or puckers in the strip at its radially inner edge; furthermore the strip may have a stepped and/or waved form. Because of the helical coiling of the strip on a core, a rotor is produced whose outer wall may be used for the radial motion therethrough of flows giving or taking up heat.

16 Claims, 8 Drawing Figures

ROTOR FOR A REGENERATIVE HEAT EXCHANGER

BACKGROUND OF THE INVENTION

The present invention is with respect to tubular rotors for regenerative heat exchangers for the transfer of heat in two flows of material making their way through the rotor of the heat exchanger in parts thereof that are walled off from each other. The rotor is made of a heat vehicle material, that is heated up by the first, hotter flow and is cooled down by the second, cooler flow or current. The separate zones of the rotor in which heating up and cooling down take place are walled off from each other and the rotor is turned in the housing of the heat exchanger so that the heat vehicle material is put firstly in contact with the hotter and then with the cooler flow in turn. The rotors that have so far been used in the prior art have the form of a tubular roller, through which two currents of material make their way, preferably in counter-current, in a direction normal to the lengthways axis of the roller. The direction of motion of the currents is first inwards and then outwards through the outer wall of the rotor so that the motion of the materials is in fact generally radial. The inside of the rotor is shut off into separate spaces in a way in keeping with the desired purpose of stopping mixing of the currents with each other. The fact that each of the currents is moved a second time through the wall of the rotor is responsible for a specially high efficiency of the heat exchange and because the motion is in counter current continuous heating is effected; in fact a heat exchanger designed on these lines may be run very effectively, as for example for recovery of heat from stale air from dwellings or working premises. However other designs of heat exchanger have been used, in which rotors, that is to say almost any form of structure that is regularly turned, are used for the transfer of heat. To this end the currents may be moved through a turning hollow body in an axial or axial-radial direction.

For the design of rotors, and more specially of tubular heat exchanger rotors in the form of rollers, a wide selection of different materials has been put forward. A homogeneous form of the wall of the rotor is for example possible if ceramics or porous synthetic resins such as open pored foam resin are used. Furthermore heat exchanger rollers have been designed using a more or less dense wire compact. In a further suggestion made in the past, such rotors were to be made in the form of composite bodies, such rotors being made up for example of sheet metal rings or of a number strips of sheet metal running along parallel to the axis of turning and placed about the rotor.

The shortcoming of such known systems is that the efficiency of the heat transfer is only low and/or the resistance to the flow is overly great. In the case of homogeneously structured rotors there is furthermore some trouble in connection with the fact that the heat vehicle material lets through the flow not only in its desired direction but furthermore in all other possible directions. If for example such a rotor is used in a heat exchanger in which the flows are moved in counter current two times in a radial direction through the exchanger, whatever steps are taken there will still be a flow, even within the heat vehicle material, in the round-the-axis direction of the rotor. This being the case, the two flows will then be mixed, a highly undesired event. In theory rotors in the form of composite bodies are better at keeping the flows separate. However known designs do however have the shortcoming that because of their complex form they may only be manufactured at a high price. For example heat exchanger rollers have in the past been been made by riveting or welding together separate metal disks into assemblies; furthermore other designs have been made using small metal plates that were placed together in the form of large vessels, as for example in the form of baskets with wire coiled round them or with coiled wire forming the wall thereof, such baskets then together forming the wall of the rotor. However the manufacture of any of these designs is so heavy on labor that they may not be put into industrial production. This being the case, rotors in the form of composite or compound bodies have so not come into general use to any marked degree.

GENERAL OUTLINE OF THE PRESENT INVENTION

One of the purposes of the invention is making a design taking care of these shortcomings of the prior art.

A further purpose of the invention is designing a tubular rotor for regenerative heat exchangers with an outer wall made up of a material effectively taking up and giving off heat and is more specially fitted for use in a system with radial motion of the flows therethrough; in this respect there is to be a high power to size ratio and the degree of mixing of the different flows is to be made so low that it is unimportant under normal working conditions.

A still further purpose of the invention is designing such a rotor, which is useful in every respect, so that it may be produced simply and cheaply.

For effecting these and further purposes and objects that will become clear on reading further parts of the present specification, a heat exchanger rotor is characterized in that its wall is made up of one or more layers of a helically coiled strip that is placed on edge in the radial direction.

Preferred further developments of the invention will be seen in the claims at the end of this specification The outer wall of the rotor is made up of one or more layers of a helically coiled or wound band or strip that is so placed on edge that it is lined up radially with respect to the axis of the rotor. By giving the strip the right form or outline ducts are formed running through the wall for the flow of medium; the coils of the strip may be placed so near together, that is to say so densely packed, that there is generally no chance of any cross or transverse flow coming into existence in the axial direction. The rotor may be produced by continuous coiling of the strip so that it becomes possible for the working inner face of the rotor to be manufactured with a single, simple tool. This being the case, the costs of production are greatly cut down and continuous or non-stop manufacture oomes into question as will be desired when large runs are to be turned out. Preferably a metal strip or band is used offering a high rate of heat transfer from the flowing fluid and furthermore a high thermal capacity. The surface grain or structure of the metal strip is produced by a simple embossing operation so that the designer is presented with a wide range of different possible forms of the completed strip and the rotor may be matched to a large number of different flow conditions.

Further useful effects presented by the invention and details thereof will be seen from the account now to be given of a limited number only of possible working examples thereof.

LIST OF DIFFERENT VIEWS OF THE FIGURES

DETAILED ACCOUNT OF WORKING EXAMPLES OF THE PRESENT INVENTION

Figure 1:
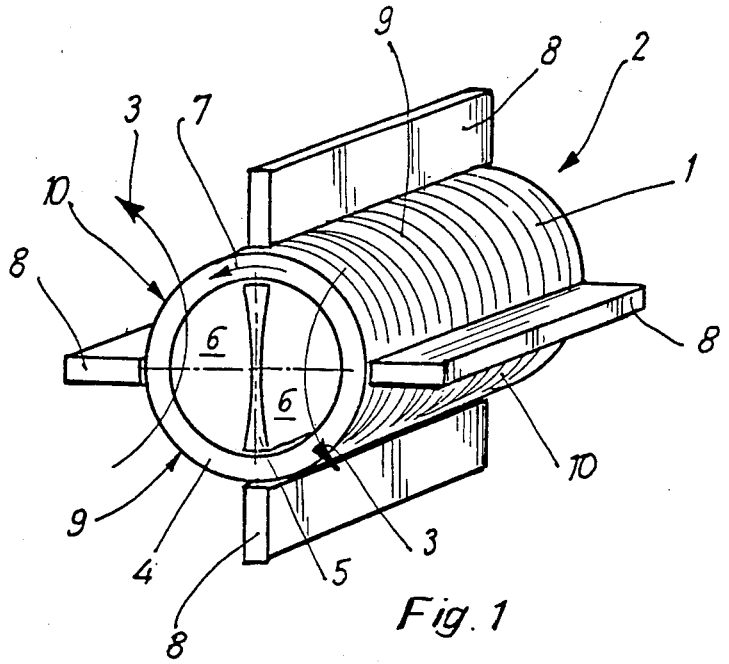
FIG. 1 is a view of a rotor in keeping with the present invention as part of a regenerative heat exchanger.

Turning now to the figures and more specially to FIG. 1 thereof, the reader will see a rotor 1 in keeping with the present invention in its working position in a heat exchanger that is generally numbered 2. The housing of the heat exchanger 2 will be seen to be broken or cut open. Two flows or currents of fluid make their way through the rotor in the direction of the arrows 3. Each of the two fluid currents makes its way more or less radially through the wall 4 of the rotor 1 twice. The space inside the rotor 1 is walled off by a parting wall 5 into two spaces 6; each of the two spaces 6 is in this respect kept for one of the currents. The parting wall 5 is fixed in position inside the rotor 1, it forming a part of the housing, in which the rotor 1 is turned, such turning being about the lengthways axis of the rotor 1 as marked by an arrow 7. The housing of the heat exchanger 2 has parting walls 8 that are placed next to the outer wall of the rotor 1 so that there is a division of such space into inlet parts 9 and outlet parts 10 for the two flows. The inlet and outlet parts for a given one of the currents are at the outer face of the rotor 1 and are spaced by an angle of 90° round the outer wall of the rotor, and the inlet and outlet spaces of any given one of the currents of fluid are diametrally opposite to each other at the outer face of the rotor. With this placing of the parts the flows are made to go through the rotor 1 in opposite directions, this being responsible for useful effects in connection with stepping up the efficiency of the heat exchanger. Generally at the inlet 9 each of the two flows is directed through the wall 4 in an inward direction, and at the outlet part 10 the flow is in an outward direction. Where the rotor 1 has fluid flowing through it the material of the rotor will be heated by one of the flows so that the fluid responsible for such heating will give up heat. As the rotor 1 is turned in the direction of the arrow 7, the heated part of the rotor 1 will then be moved on to the other flow, which will take up heat from the rotor, that is to say it will be heated up by the rotor 1, which will be cooled down. As the rotor is moved on farther, the cooled part of the rotor wall will be moved back into the hot fluid flow and the heat thereof will be taken up by the rotor wall and transferred thereby to the other flow and so on.

Figure 2:
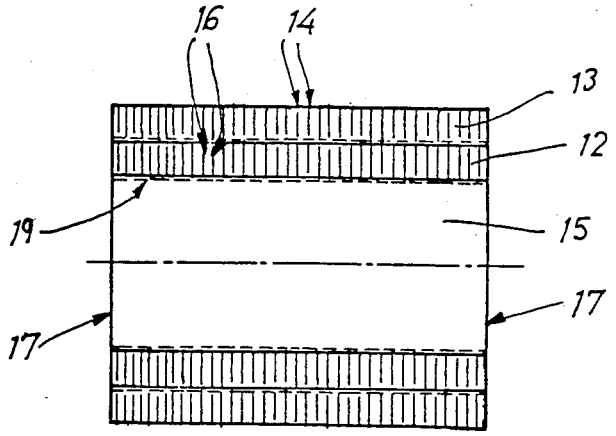
FIG. 2 is a lengthways section through a rotor with a strip coiled in two layers.

The rotor 1 has the form of a tubular casing of round cross section. Its wall 4 is, in keeping with the present invention, made up of one or more layers of a helically coiled strip 11, that is "on edge", that is to say on edge on an imaginary cylinder. In FIG. 2 a rotor 1 is to be seen with two such layers 12 and 13. The reader will see that the inner layer 12 has the outer layer 13 placed concentrically round it. The two layers 12 and 13 are coiled directly on top of each other so as to have a common axis, this axis being the axis of the heat exchanger roller. Single coils of one layer 13 are marked at 14. The rotor 1 has a core 15 used as a support for the coils of the strip 11.

The structure of the core 15 is such as to let through the flows. The core may be more specially be made of perforated metal tubular casing with a large free or flow cross section; in this case the flows of fluid make their way through the perforations in the wall of the core 15. The design of the core 15 so as to be made of a tube with openings therein gives the useful effect that there is a smooth running face for the parting wall 5 and the same may be placed very near to the inner face of the face of the core 15. Another point is that the tubular core 15 may be made so stiff that it may at the same time be used as a support for the rotor 1 in the housing of the heat exchanger 2. However, the design may be changed in such a way that the core 15 is made of stiff woven wire structure. Or the core 15 may be in the form of cage having a large number of rods running parallel to each other along the outer face of a cylinder with means joining their ends for supporting same. The openings in the woven wire or the spaces between the rods will in this case take the form of openings for the flows of fluid so that they may make their way therethrough with only a low hydrodynamic or aerodynamic resistance.

Figure 3:
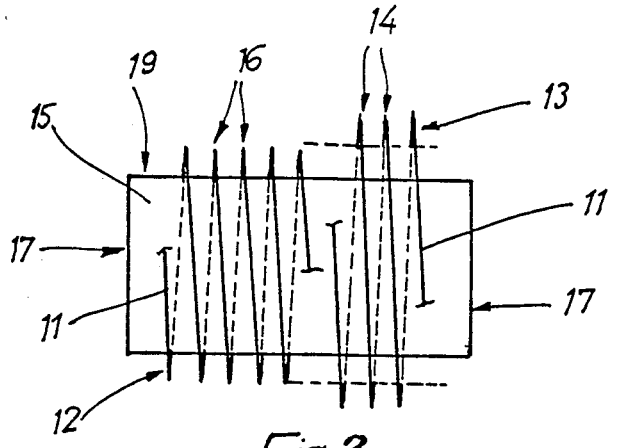
FIG. 3 is view of a rotor as in FIG. 2 while the strip is being coiled thereon.
Figure 4:
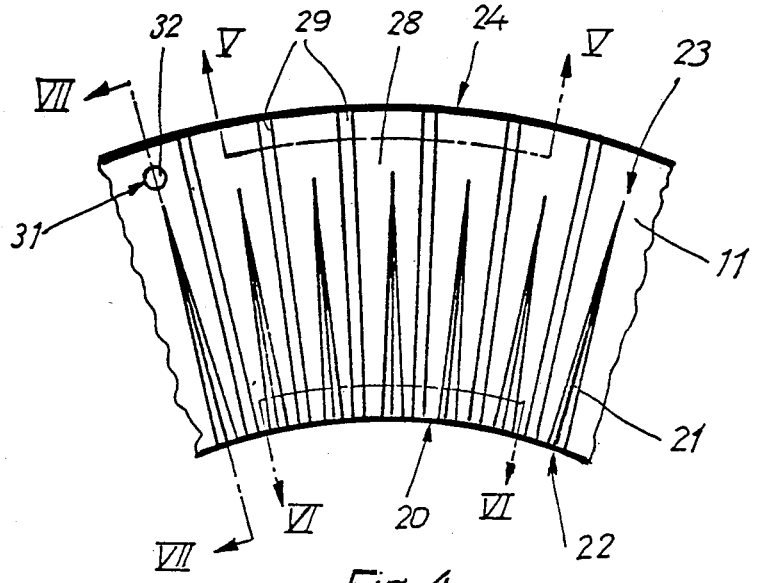
FIG. 4 is a plan view of the strip forming the outer wall or casing of the rotor.

In FIG. 3 the operation of coiling the layers 12 and 13 about the core 15 will be seen diagrammatically. The strip or band 11 is firstly run in the form of a helix directly onto the core 15, each coil 16 thereof coming to take up a position right up against the next coil 16 thereto flatwise so that each coil is supported by the coils next to it so that a sort of stack is produced. The strip 11 is a flat part on edge resting on the core 15 so that it is running out from the core 15 in a more or less radial direction. For starting the coiling operation the end of the band 11 may be fixed on the core 15 and it is more specially possible for the core 15 to have two covers 18 and its ends 17, such covers running out over the outer face of the core 15 and gripping the strip between them. As part of a preferred form of the invention, the strip is clamped between such covers 18 and more specially tightly coiled between the covers 18 so that it is kept in position because of its own natural elastic properties. Once the inner layer 12 of the strip has been coiled on the core 15, the outer further layer 13 may be coiled up in position (if such a further layer is desired), the same being supported and based on the inner layer 12. As will be made clear in a further part of the present specification, only one layer of the strip 11 will be needed for many uses, although it is furthermore possible to have two and more layers 12 and 13 coiled or wound on the core 15.

One working example of the strip 11 as used in the coiling operation is to be seen in FIGS. 4 to 7. At the start before the coiling operation the strip 11 has a rectangular outline. Such strip material is on the market in a large number of different lengths, breadths and thicknesses and is normally supplied coiled on drums or reels.

For coiling it on the round, cylindrical core 15 the strip 11 is puckered or pleated along the radially inner edge 20 that is to be placed on the core 15. The puckering effect is caused by producing wedge-like folds 21 running across at least part of the breadth of the strip. These folds 21 may be produced quite simply in the strip 11 by embossing,. The wider end or base 22 of each wedge-fold 21 is placed at the radially inner edge 20 of the strip, whereas the points 23 are directed towards the radially outer edge 24. As the reader will at once see from FIG. 4 this puckering or pleating makes the radially inner edge 20 shorter, as seen in a vertical projection, than the opposite, radially outer edge 24 so that the strip 11 has a curved form. The radius of curvature in this respect is in keeping with the curved form of the core 15. At the same time the surface of the strip 11 will have a folded form so that ducts 25 are formed between one strip coil 14 and the next coil 16 of the strip 11. It is because of the presence of these coils that the flows are able to make their way through the wall 4 of the rotor, such flow direction being by nature radial. In fact the radial form of the ducts has the effect of stopping any undesired motion of the fluid in the round-the-axis direction because the parts of the coils 14 and 16 of the strip 11 are placed against each other, such parts being between the folds or pleats 21 and being generally flat and even. If throughout the wall each one coil 14 is lined up with the next coil such as 16 of the strip 11 and if the force pressing the coils together is great enough it is possible to make certain that there will be a gas-tight contact between the coils and there will hardly be any chance of the gas flows moving in the wall in the round-the-axis direction.

For most uses the rotor's outer wall 4 will be made up of a single layer 12 only of the strip 11 that has been pleated in the way noted. It will fact only be in the case of uses in which the rotor wall 4 has to be very thick and the rotor 1 is to have a relatively small diameter that the puckering of the radially inner edge 20 of single layer 12 of the strip 11 has to be so great that it would be in the way of the flowing fluid. In such cases a useful effect is to be had if the rotor has two or more layers 12 and 13 made up of the strip 11, the said layers being placed concentrically in the way noted hereinbefore. Each of the said layers 12 and 13 will have its radially inner edge part puckered in the way noted. In this respect the degree of puckering of the next layer 13 on the outer side of the layer in question is matched to the radius of curvature, that is in keeping with the outer diameter of the layer 12 on the inner side. As a further point the puckering of the outer layer 13 may be such that ducts 25 are formed running right the way through the full depth of the casing or wall 4 Different layers 12 and 13 of the strip may be puckered so that the creases or folds therein are in step with each other and there will then be a tendency towards a random distribution or placing of the ducts in the wall 4. The puckering or creasing may furthermore be different from case to case and be designed so that there is a tendency for the ducts 25 to be lined up with each other.

Figure 5:
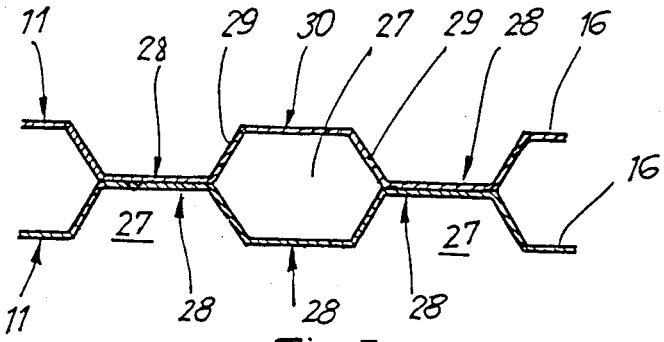
FIG. 5 is a section of the strip taken on the line V—V of FIG. 4.
Figure 6:
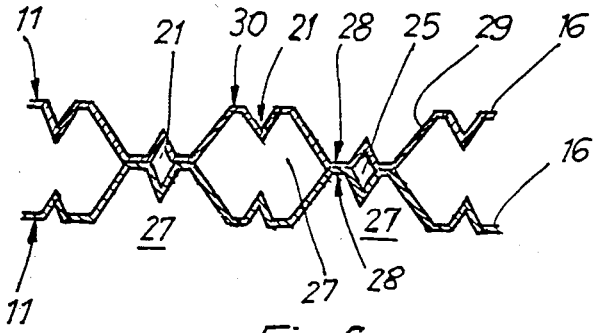
FIG. 6 is a section taken along the strip on the line VI—VI of FIG. 4.
Figure 7:
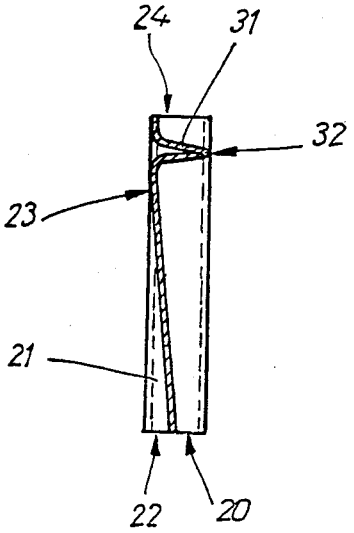
FIG. 7 is a section through the strip taken on the line VII—VII of FIG. 4.

The creasing of the strip 11 may in itself be enough for the rotor 1 to let through the flows to the desired degree, that is to say for the resistance to the flows to be low enough. In keeping with a preferred example of the invention, however, the strip 11 may be corrugated as well. Such a corrugated or wavy form of the strip 11 or band will give birth to openings 27 between the corrugations of one coil such as 14 and the next one such as 16. The currents will then be able to make their way through such openings. In FIGS. 5 and 6 the reader will see to coils 16, placed next to each other, of a corrugated strip 11, the corrugations thereof being wavy or rounded and not square.

In this respect the tops or crests of the waves are in the form of flat stages 28, 30 or mesas at which the coils are rested against each other fluid tightly. Between these support stages 28 there are the said openings 27 between the half waves so that looked at generally it will be seen that the wall 4 of the rotor 1 has a honeycomb structure. In the present working example the half waves of the corrugated structure have a trapezoidal cross section; the flat support stages 28 are joined together by sloping sides 29. It is however furthermore possible for the wave structure to be right angled or stepped and not with sloping sides as figured herein. In this case the sides 29 would be generally radial. Such a square wave structure with flat support stages 28 is useful when it comes to making a fluid-tight join between the coils 16. It is however furthermore possible for the wave structure to be made up of waves with a half-circular cross section so that normal corrugated sheet material might be used for producing the coils of the wall of the rotor 1, although this is not figured here.

For producing the puckering or creasing of the specially formed strip 11 each of the half waves has a wedge-like pucker or groove 21 therein, such puckers being turned first in one direction and then in the other along the strip 11 so that they are placed on the two sides thereof. The outcome of this is the highly useful openwork structure to be seen in FIG. 6. The grain structure and the puckering of the strip 11 is more specially undertaken in a single working operation and using one common tool. To be certain of producing a good sealing effect between one coil 16 and the next one resting against it, an important point is that the tops of the waves are at a completely regular height all over the strip 11. This makes certain that each coil is quite regularly placed against the coil 16 next thereto. A further point in connection with producing a good sealing effect is that the number of support stages 28 is to be as large as possible over the outer face of the rotor 1. To this end the pitch of the wave-like grain or grooving, that is to say its wavelength, is to be made very small so that only very narrow ducts 25 are formed. For commercial sizes of rotors wavelengths or wave pitches of 0.5 to 3 cm have turned out to be useful. The grooving operation is generally undertaken with the purpose of producing an increase in the size of the heat transfer surface and stepping up the power to size ratio of the rotor 1; on the other hand the clearance width of the groove ducts 25 has an all-important effect on the flow resistance of the rotor 1, which would be less good if the wavelength selected were overly small. The wavelength is to be matched to the size of the outer face of the rotor 1 in such a way that each of the coils 16 of the strip 11 are out of line with the coils next to them by half a wavelength, see in this respect FIGS. 5 and 6. This system in which the wave tops or crests of one group of waves are opposite to the valleys of the coil 16 next thereto, is the best way of making certain that the strip 11 is not pushed together on coiling the same onto the core 15. If more than one layer of the strip 11 is coiled one on top of the other the wavelength of the outermost layer 13 is to be matched to be in keeping with the outer diameter of the inner layer 12. In complete agreement with the puckering noted hereinbefore, it is furthermore possible for steps to be taken to see that the groove openings 27 of one layer such as 11 and the next one thereto such as the layer 13 are in line with each other; however it is furthermore possible for the layers of a grooved or grained strip 11 to be coiled on top of each other without giving any attention to such points of design with the outcome that there will be a random placing of the openings 27.

In addition to the grooving and puckering noted hereinbefore the strip 11 may be formed with structures for the purpose of spacing one coil such as 14 from the next one such as 16 and/or for causing eddies or vortices in the flows moving through the rotor 1. Only as one possible example of this the reader will be able to see in FIGS. 4 and 7 a bulge 31, that is positioned at the outer face of the strip 11. The height of the bulge 31 is in keeping with the depth of the grooved structure. Coils such as 14 and 16 of the strip 11 that are next to each other are for this reason rested against each other not only at the support stages 28 but furthermore at the crest 32 of their bulges 31. It is for this reason that there is a better spacing effect between coils 14 and 16 that are next to each other. At the same time the bulges 31 are in the path of the flows so that turbulence is produced thereby and for this same reason the transfer of heat to the wall 4 of the rotor will be increased. The bulges 31 of the sort noted may be present in all or in only part of the openings 27 produced by the grooving. It is best in this respect to have a system in which every second or third opening 27 has such a bulge 31. This system is very simply manufactured and gives a better spacing effect without, in substance, making the resistance to flow any greater.

The forming of the strip 11 to give the desired outline in the way noted hereinbefore is best undertaken in an embossing process or step. The strip 11 is made of a material that may be readily worked by embossing and more specially the strip may be in the form of light alloy strip as for example aluminum foil or a sheet material made of an aluminum alloy, such material offering the useful effect that it is has a low weight and furthermore the metal aluminum is very resistant to corrosion. For a preferred use in a heat exchanger 2, that is placed in the inlet and outlet airflows of an air-conditioned room, there may be a further development of the invention such that the aluminum strip 11 is produced with a processed surface so that the humidity in the air is transferred as well. In this system the humidity in the stale air from the room on moving through the wall 4 of the rotor will be deposited on the adsorbing surface of the strip 11 and when the wall of the rotor then goes into the flow of air on its way into the room such humidity will be taken up thereby and make its way into the room: that is to say, at the same time as the heat is exchanged there is an exchange of water between the flows, this putting an end to unpleasing dryness of the air in air conditioned rooms. A further point in this connection is that that such an exchange of humidity is practically the exchange of latent heat so that the enthalpy efficiency of the rotor is stepped up.

Figure 8:
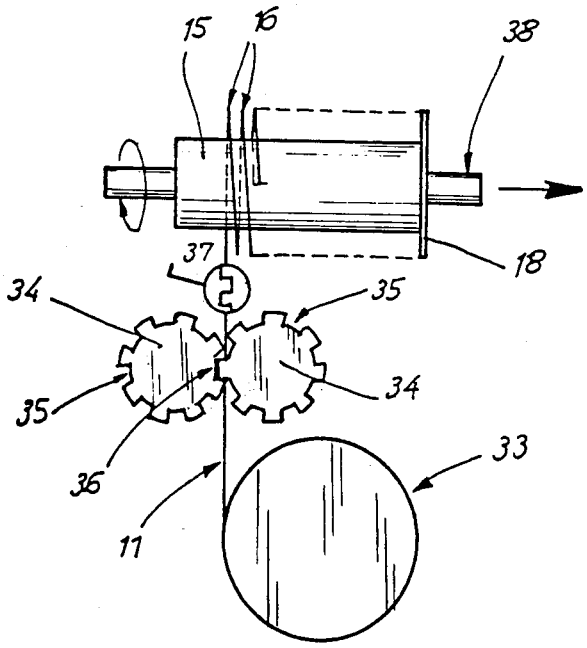
FIG. 8 is a view of an apparatus for producing the rotor.

FIG. 8 is a diagrammatic of a process for the manufacture of a rotor 1 in keeping with the invention. The aluminum foil on a reel or coil 33 is moved through between two embossing rolls 34 and embossed thereby. The embossing rolls 34 have mating outer faces 35 that are negatives of the form of the strip 11 with the waves and grooves. The embossed form or structure is repeated round the outer faces 35 of the rolls. If spacing structures and or bulges 31 for producing turbulence and eddies are desired, the embossing structures may be produced with heads or buttons or the like proud of the rest of the surface. The embossing rolls 34 are run against each other meshing at the embossing nip 36. After the strip 11 has been run through the embossing nip it will have the desired grooved or grained surface structure, as marked in detail at 37. The strip 11 is then run onto a core 15 smoothly and without stopping, the core 15 being placed on a mandrel 38, the core 15 and the mandrel turning about an axis, that is normal with respect to the axis of turning of the embossing roll 34. At the same time as it is turned, the mandrel 38 is moved along this axis so that the strip 11 is coiled helically onto the said core 15. As an end stop for the coils 16 the is a cover 18 at the end of the core 15 and it will be seen that with this process rotors 1 may be continuously produced. An effect that is more specially of value in this respect is that all the acting face of the rotor wall 4 is produced using but one single tool. This is responsible for a very simple structure; more specially in the case of the apparatus of FIG. 8 the drive power for the embossing rolls 34 and the mandrel 38 may be taken through gearing from a single main drive, The rotor 1 in keeping with the present invention may for this reason be produced simply and at low price. The grain or embossed pattern on the wall 4 may be changed quickly quite as desired at any time by simply changing over the embossing rolls 34 so that there is the best possible adaptation to different overall sizes of rotor and flow conditions. This being the case, it is possible for rotor designs to be produced on a case to case or fully customized basis so that the rotor has a high efficiency, a good power to size ratio and a low resistance to flow. In place of using two rolls it is naturally possible for the strip 11 to be embossed in some other way, as for example using embossing tools that are moved together and then moved away from each other so that the embossing of the strip 11 takes place in steps. Furthermore a combination of the two forms of process would be possible.

The manufacture of a rotor with more than one layer 12 and 13 may take place as noted by coiling the layers right on top of each other. A simpler process is one in which the outer layer 13 is firstly coiled onto a core 15 and the with or without this core 15, that may be designed to let a flow through it, it is placed on the inner layer 12. If a number of different sizes of layers are made with carefully thought out diameters, the outcome will be a modular system of rotor components, that may be pieced together to make up quite a large range of different forms of rotor with customized wall thicknesses and diameters. On pushing one layer 12 or 13 into another other the coils may be so placed that they are in a random order in relation to each other so as to give an efficient and simply produced heat exchanger.

I claim:

1. A tubular regenerative heat exchanger rotor comprising a tubular wall made of a material for taking up and giving up heat said wall being made up of at least one layer of a helically coiled strip placed on edge so as to be lined up with a line that is radial with respect to an axis of said tubular rotor, said strip being provided with radially oriented grooves which pucker or tie up the strip in the region of its inner edge, the strip being coiled onto a core that has a structure designed to let fluid flow therethrough, the radially oriented grooves being wedge-like with a wider section of the wedge-like groove being at the radially inner edge and extending only over a part of the breadth of said strip, and said strip further being corrugated with corrugations of individual layers constituting fitting regions which lie sealingly one against the next so as to prevent flow in circumferential or axial direction.

2. The rotor as claimed in claim 1 wherein said strip is corrugated in steps with corrugations therein, said corrugations having crests forming flat stages at which one coil of said strip may be rested against the coil thereof next thereto.

3. The rotor as claimed in claim 2 wherein the corrugations have half-waves that are angular.

4. The rotor as claimed in claim 1 wherein the corrugations are made up of half-waves with a half-circular cross section.

5. The rotor as claimed in claim 1 wherein the corrugations are made up of half-waves, whereof each has a wedge-like groove and the grooves on any one half-wave are on a different side of said strip to the grooves of the coil next thereto.

6. The rotor as claimed in claim 1 wherein the strip has corrugations with a small pitch, the corrugations being of regular height over the level of the strip.

7. The rotor as claimed in claim 6 wherein the said pitch is in a range of 0.5 to 3 cm.

8. The rotor as claimed in claim 1 wherein said strip has corrugations that from one coil to the next one in the wall of the rotor are out of line with each other by half the pitch of corrugations.

9. The rotor as claimed in claim 1 wherein said strip has bulges for use as spacers

10. The rotor as claimed in claim 1 wherein said strip has bulges for use as means for causing eddies in said flows.

11. The rotor as claimed in claim 1 having at least two such layers placed on top of one another on said core radially, said strips of said cores being puckered on edges thereof that are radially on the inside of said strips.

12. The rotor as claimed in claim 11 wherein said core has covers at ends thereof for gripping said strip therebetween.

13. The rotor as claimed in claim 1 wherein said strip is made of sheet metal.

14. The rotor as claimed in claim 13 wherein said is strip is aluminum strip.

15. The rotor as claimed in claim 14 wherein said strip has a coating thereon to take up humidity.

16. The rotor as claimed in claim 1 wherein said puckering of said strip is caused by embossing.

* * * * *